US008099824B2

(12) United States Patent
Dingert et al.

(10) Patent No.: US 8,099,824 B2
(45) Date of Patent: Jan. 24, 2012

(54) SQUEEZING DEVICE FOR A FLAT-BODY WIPER AND CLEANING SYSTEM

(75) Inventors: Uwe Dingert, Absteinach (DE); Ralf Juergens, Hemsbach (DE)

(73) Assignee: Carl Freudenberg KG, Weinheim (DE)

( * ) Notice: Subject to any disclaimer, the term of this patent is extended or adjusted under 35 U.S.C. 154(b) by 980 days.

(21) Appl. No.: 10/382,419

(22) Filed: Mar. 6, 2003

(65) Prior Publication Data

US 2003/0167589 A1 Sep. 11, 2003

(30) Foreign Application Priority Data

Mar. 9, 2002 (DE) ..... 102 10 569

(51) Int. Cl.
*A47L 13/58* (2006.01)

(52) U.S. Cl. ..... 15/260; 15/228

(58) Field of Classification Search ..... 15/260, 15/229.3, 229.7, 228, 229.6
See application file for complete search history.

(56) References Cited

U.S. PATENT DOCUMENTS

| | | | | |
|---|---|---|---|---|
| 1,652,800 | A | 12/1927 | Schulman | |
| 1,722,130 | A | 7/1929 | Finstad | |
| 2,787,015 | A * | 4/1957 | Flam | 15/142 |
| 2,880,438 | A | 4/1959 | Lensing | 15/142 |
| 4,071,983 | A * | 2/1978 | Thielen | 451/525 |
| 4,843,674 | A * | 7/1989 | Jones | 15/147.1 |
| 4,845,800 | A | 7/1989 | Pederson et al. | 15/228 |
| 4,912,804 | A * | 4/1990 | Pasbol | 15/262 |
| 5,218,734 | A | 6/1993 | Sacks | |
| 5,926,896 | A * | 7/1999 | Allemann et al. | 15/147.2 |
| 5,974,621 | A * | 11/1999 | Wilen | 15/261 |
| 6,006,397 | A | 12/1999 | Williams et al. | 15/261 |
| 6,115,877 | A * | 9/2000 | Morad et al. | 15/261 |
| 6,530,112 | B2 * | 3/2003 | Hirse | 15/260 |
| 2002/0066152 | A1 | 6/2002 | Dingert | 15/260 |
| 2002/0095739 | A1 * | 7/2002 | Dingert | 15/260 |
| 2003/0056315 | A1 * | 3/2003 | Salmon | 15/261 |

FOREIGN PATENT DOCUMENTS

| | | | |
|---|---|---|---|
| DE | 4011713 | | 4/1990 |
| DE | 9301615 | | 5/1993 |
| DE | 19620633 | | 5/1996 |
| DE | 10008331 | A1 * | 9/2001 |
| DE | 10045525 | | 2/2002 |
| DE | 100 58 509 | C1 | 7/2002 |
| EP | 0858766 | | 5/2003 |
| GB | 1091919 | | 11/1967 |
| GB | 1360882 | | 7/1974 |

* cited by examiner

*Primary Examiner* — Laura C Guidotti
(74) *Attorney, Agent, or Firm* — Pearl Cohen Zedek Latzer, LLP

(57) ABSTRACT

A squeezing device for a wiping cover of a flat-body wiper, the wiper cover hanging downward and partially detached from a wiper plate of the flat-body wiper in a vertical position of the wiper plate, the wiper plate including a downward facing pressure surface in the vertical position. The squeezing device includes a funnel-shaped squeezing shaft having a counterpressure surface in a lower region of the squeezing shaft. The squeezing shaft is configured to receive the wiper cover and at least a portion of the wiper plate in the vertical position of the wiper plate so that a squeezing pressure of the pressure surface against the counterpressure surface squeezes out the wiper cover. The squeezing shaft includes stabilizing devices configured to stabilize the wiper plate against tipping relative to a first plane from the vertical position. In addition a cleaning system including the squeezing device and a method of squeezing a wiping cover of a flat-body wiper with the squeezing device.

29 Claims, 5 Drawing Sheets

SQUEEZING DEVICE FOR A FLAT-BODY WIPER AND CLEANING SYSTEM

This application claims priority to German Patent Application DE 102 105 69.3-15, filed Mar. 9, 2002, which is incorporated by reference herein.

BACKGROUND

The present invention relates generally to a cleaning device, and particularly to a squeezing device for a wiping cover of a flat-body wiper. Furthermore, the present invention relates to the use of such a squeezing device and a cleaning system, which includes such a squeezing device.

A cleaning device having a flat-body wiper and a squeezing device for a wiping cover of a flat body wiper is known from German Patent Document DE 196 20 633 C2. The flat-body wiper has a handle and a wiper plate, which is connected to the handle via a connection element having a joint. In the forward region of the wiper plate, viewed in the wiping direction, a clamping device is positioned for attaching a wiping cover. In the rear region, the wiping cover is held by the wiper plate pressing down its fabric. To squeeze out the wiping cover, the flat-body wiper together with the wiper plate is lifted off of the floor, the wiper plate folding downward into a vertical position and the wiping cover, which is only attached at the front end of the wiper plate, hanging vertically downward. The wiping cover is now introduced in this position into the squeezing basket, which tapers conically downward, vertically from above, so that the covering lies in folds. By exerting pressure on the handle, the wiping cover is squeezed out via the downward pointing face of the wiper plate in the squeezing basket. The known cleaning device has the disadvantage that the wiping cover must be placed very carefully as it is inserted into the squeezing basket in order to reach the desired fold arrangement. Parts of the wiping cover which do not come to rest under the pressure surface, but laterally thereof on the inner wall of the squeezing shaft, are not squeezed out. Care must also be taken that the handle is in the most vertical position possible as pressure is exerted, so that the force exerted by the user is converted as effectively as possible into a squeezing force and is not directed against the lateral wall of the squeezing shaft, through which the danger of tipping the container carrying the squeezing device, which has cleaning fluid, arises. A further disadvantage is that, in the operating position, the wiping cover is only fixed in the forward region of the wiper plate. In order to avoid slipping of the wiping cover in the rear region, in particular in the event of high floor friction, the user must continuously exert an appropriate pressing force on the handle during wiping.

A two-part wiper plate having plate wings, which are pivotably mounted via folding shafts, in which the plate wings may be folded vertically downward for cleaning purposes, is known from German Patent Application DE 40 11 713 A1. The wiping cover is attached only at the end of the plate wings and sags downward in a loop shape when the plate wings are in the folded-down position. In this position, it may be dipped into a liquid bath and cleaned. It cannot be inferred from the publication whether and/or how the wiping cover is squeezed out upon completion of the cleaning.

SUMMARY OF THE INVENTION

An object of the present invention is to refine a squeezing device for a wiping cover of a flat-body wiper in such a way that the wiping cover is automatically brought into the optimum position for squeezing out when it is inserted into the squeezing shaft, without this requiring special handling by the user and without danger arising of tipping the container carrying the squeezing device. An additional or alternate object of the present invention is to provide a cleaning system including a flat-body wiper and a squeezing device, in which the flat-body wiper and the squeezing device are tailored to one another in such a way that wringing out may be performed easily and efficiently, but the functioning of the flat-body wiper is not impaired due to its tailoring to the squeezing device.

According to the present invention, in a squeezing device for a flat-body wiper, which includes an essentially funnel-shaped squeezing shaft, which tapers conically downward, having counterpressure surfaces, into which the wiping cover, in an essentially vertical position of the wiper plate, partially detached therefrom and hanging downward, may be introduced from above and squeezed out through pressure on the handle, the wiper plate also being able to be at least partially introduced into the squeezing shaft for the squeezing, so that its face pointing downward forms a pressure surface, and devices are provided for stabilizing the wiper plate against tipping during insertion and squeezing out in the squeezing shaft. Using this measure, the wiping cover and the wiper plate are automatically guided, already during insertion into the squeezing shaft of the squeezing basket, in such a way that the wiping cover is automatically brought into a favorable position for squeezing and the force exerted by the user is automatically optimally converted into pressure on the wiping cover. In particular, lateral forces on the walls of the squeezing shaft, which could cause the container supporting the squeezing device, which contains cleaning fluid, to tip, are avoided.

The devices for stabilizing the wiper plate against tipping preferably include two diametrically opposed first inner walls of the squeezing shaft in a first plane, their distance to one another being dimensioned in such a way that the wiper plate is supported simultaneously on both inner walls as it is inserted into the squeezing shaft.

Alternatively, the distance not between the inner walls themselves, but rather between corresponding first guide elements on these inner walls and/or between first guide elements on one of the inner walls and in particular another inner wall may be dimensioned in such a way that the wiper plate is simultaneously supported on both sides, as described above, as it is inserted into the squeezing shaft. Such first guide elements may be, for example, vertical, rib-like elevations on one of the inner walls or on both inner walls.

For complete stabilization of the wiper plate, specifically against tipping in a second plane, perpendicular to the first plane, second guide elements, on which corresponding counter-guide elements on the wiper plate are supported, are additionally provided on at least one of the two first inner walls.

The first guide elements may be designed in such a way that they also assume the function of the second guide elements. This may be implemented most simply by implementing the guide elements as rib-like elevations on the first inner walls of the squeezing shaft, which are positioned in such a way that they may be engaged with the corresponding counter-guide elements on the wiper plate.

The height of the squeezing shaft is advantageously dimensioned in such a way that the lower ends of the wiper plate already dip into the upper region of the squeezing shaft and are engaged with the devices for stabilizing the wiper plate against tipping when the wiping cover touches the floor of the squeezing device. In this way, it is largely ensured that the force now to be exercised on the handle to compress the wiping cover in the squeezing shaft may not also result in tipping of the squeezing device when the handle is not perfectly aligned perpendicularly.

For a two-part wiper plate having plate wings which may be folded downward and a wiping cover which sags downward in a loop shape, as is described in greater detail below, for the typical dimensions of such a wiper plate, a height of the loop of approximately 15 cm results for the wiping cover which sags downward in a loop shape. The height of the squeezing shaft is therefore to be greater than 15 cm for such a wiper plate. It has been found that an immersion depth of approximately 1 cm is sufficient for the lower ends of the wiper plate wings to achieve sufficient stabilization against tipping. The squeezing shaft may preferably have a height of at least approximately 16 cm.

It is particularly advantageous if the first inner walls are the walls diametrically opposed to the top and/or underside of the wiper plate brought into a vertical position. In this manner, the wiper plate is supported using its larger surfaces when it is inserted into the squeezing shaft and especially secure guiding is achieved.

A particularly efficient conversion of the force exerted by the user on the handle of the flat-body wiper into a contact pressure is achieved if the squeezing shaft is dimensioned in such a way that inner walls forming the guide surfaces and the arrangement of the guide elements are tailored to a wiper plate brought into a vertical position around its longitudinal axis. In this case, the relatively small face, which points downward, forms the pressure surface.

This also applies correspondingly to a two-part wiper plate having plate wings folded downward around the shorter transverse axis. The pressure surface is formed by the two faces of the wiper plate wings folded downward in such an embodiment. In comparison to the cleaning system initially cited, known from the related art, in which the wiper plate may be folded downward around its longitudinal axis and the pressure surface is formed by the lateral surfaces of the wiper plate wings, a contact pressure which is higher by a factor of 4 results for a wiper plate folded around the transverse axis.

Furthermore, the insertion of the wiping cover and the wiper plate into the squeezing shaft is made easier if the squeezing shaft has an insertion funnel on its upper end which expands greatly upward.

In order for the cleaning liquid to escape easily as it is squeezed out, the squeezing shaft has drain openings in the lower region and in the shaft floor. These may be groove-shaped openings, for example.

The counterpressure surfaces in the squeezing shaft may have elevated regions to increase the contact pressure. For example, it has been found to be advantageous if the shaft floor (2*a*), as shown in FIGS. 1 and 5, is provided with rib-like elevations 2(*b*), as shown in FIG. 5.

The squeezing device preferably includes an attachment device for attachment to a container for the cleaning liquid, for example a bucket.

Furthermore, it is advantageous if the squeezing device additionally includes a holding device for holding the flat-body wiper in the container.

A cleaning system according to the present invention includes the squeezing device according to the present invention in combination with a flat-body wiper having a handle and a wiper plate having a detachably attachable wiping cover, the wiper plate being able to be brought into an essentially vertical position to squeeze out the wiping cover and being able to be inserted into the squeezing shaft of the squeezing device with the wiping cover partially detached and sagging downward, its face pointing downward forming a pressure surface.

The squeezing device according to the present invention may be used not only in combination with a flat-body wiper having a one-piece wiper plate, but also particularly advantageously for flat-body wipers of the type described in the introduction to the description, which are known per se, having a two-piece wiper plate having two plate wings, which may be folded together, and a wiping cover which is detachably attachable to the ends of the plate wings pointing outward, the plate wings being able to be folded downward into an essentially vertical parallel position to clean the wiping cover in a cleaning liquid, so that the wiping cover sags downward in a loop shape. According to the present invention, the flat-body wiper is inserted from above into the squeezing shaft of the squeezing device in this position with the plate wings folded down and the wiping cover sagging downward in a loop shape.

Essentially, the statements made generally about the squeezing device according to the present invention, in regard to the dimensions and arrangement of the guide surfaces and guide elements in the squeezing shaft of the squeezing device according to the present invention as well as the other preferred embodiments of the squeezing device according to the present invention, also apply to the cleaning system according to the present invention having a flat-body wiper having a two-piece wiper plate, with the only difference being that the vertically aligned top sides of the two folded-down plate wings and the loop-shaped wiping cover, which sags downward, take the place of the top and/or underside of the one-piece wiper plate brought into a vertical position and the wiping cover, which sags downward.

The squeezing device may be used particularly advantageously for a flat-body wiper having a two-piece wiper plate of the type described, which, in addition to the foldable plate wings, also has a middle part permanently attached to the handle. Such a middle part may be implemented on the side facing the surface to be cleaned as a functional surface having an additional cleaning function, which is operable by exerting pressure on the handle. The functional surface is preferably implemented as a "scrubber"0 surface for removing stubborn stains and has a texture for this purpose. In this case, the ratio between the elevated regions formed by the texture to the total surface of the wiper plate is advantageously between 1:10 and 1:100, in particular preferably approximately 1:50. At a ratio of 1:50, approximately the same contact pressure is achieved on the surface to be cleaned with the aid of the textured functional surface as if a scrubber is used. The texture may be implemented in the form of ribs, for example, which may be positioned perpendicularly or, in order to produce independence from the wiping direction, at an angle to the wiping direction. In order for the textured functional surface to be effective under the wiping cover, the ratio between the thickness of the wiping cover and the texture height is to be between 2 and 1.

The plate wings of the two-piece wiper plate may have support elements on their underside, which stabilize both plate wings against relative movement in the plate plane in the folded-down parallel position. Such support elements may be elevations on the underside of one plate part, which engage in corresponding depressions on the underside of the other plate part in the folded-down position, for example.

The plate wings are advantageously lockable in the aligned operating position using a catch. The handling is particularly simple in this case if the locking occurs automatically when the plate wings are pivoted up into the operating position and a foot-operated lever, for example, is provided to remove the locking. Catch devices having the properties described are known and have been described many times in the literature.

The handle of the flat-body wiper may be connected to the wiper plate via a joint, preferably via a universal joint. For squeezing out, it is advantageous if the joint is at least partially lockable, using spherical pressure parts, for example.

The wiping cover, whose shape approximately corresponds to the shape of the wiper plate, has a cleaning fabric on its underside. There are no restrictions in regard to the type or implementation of the cleaning fabric. The wiping cover is detachably attachable in the edge regions of the wiper plate, i.e., at the outer ends of the plate wings. The wiping cover preferably has holding tabs on its shorter ends, which overlap the outer ends of the plate wings in the edge region. These holding tabs may be laid around the outer ends of the plate wings and may preferably be attached on the top side of the plate wings in the edge region using a hook and loop fastener. However, other attachment possibilities are also conceivable, such as snap fasteners.

A cleaning system according to the present invention includes a container for receiving the cleaning liquid, in whose upper region the squeezing device is attachable. A holding device for setting down the flat-body wiper may be also expediently provided in the container.

BRIEF DESCRIPTION OF THE DRAWINGS

In the following, the present invention is described in greater detail on the basis of the drawings, in which.

DETAILED DESCRIPTION

Figure 1:
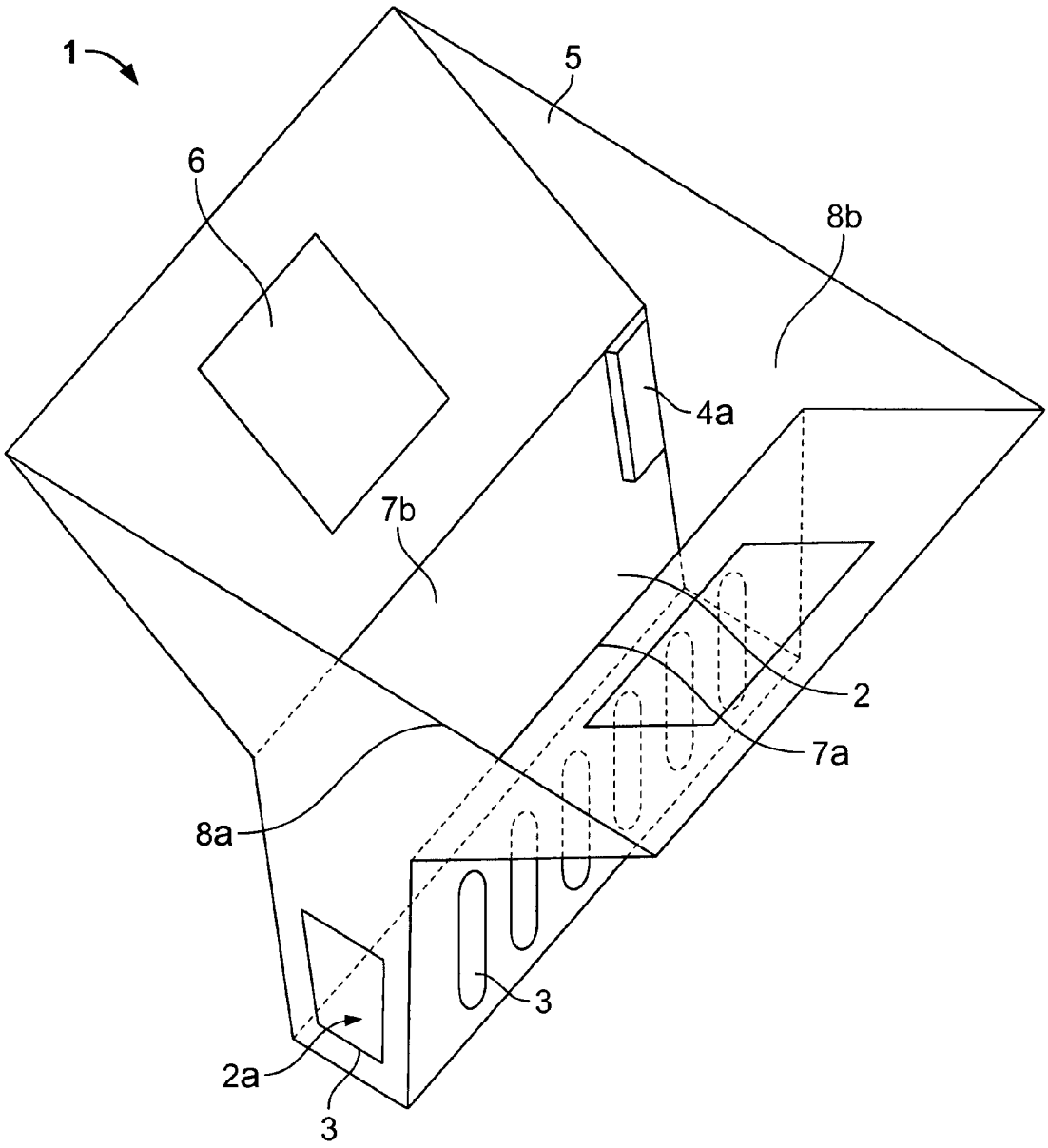
FIG. 1 shows a perspective illustration of a squeezing device according to the present invention.

A squeezing device 1 according to the present invention, having a squeezing shaft 2 having inner walls 7*a*, 7*b* and/or 8*a*, 8*b* diametrically opposed to one another, is shown in FIG. 1. Squeezing shaft 2 has a conically downward tapering shape, which is essentially funnel-shaped, having a shaft floor (2*a*) with a rectangular cross section, as shown in FIG. 1. Counterpressure surfaces and drain openings 3 for draining the cleaning liquid squeezed out of the wiping cover are located in the lower region. Furthermore, guide elements 4*a*, on which corresponding counter-guide elements on the wiper plate are supported, may be seen in the upper region of squeezing shaft 2. An insertion funnel 5 adjoins squeezing shaft 1 from above. This funnel expands greatly conically upward and is used as an insertion aid for the wiping cover with the wiper plate. Rectangular openings 6 are positioned on two diametrically opposed lateral surfaces of insertion funnel 5, into which the two ends of a middle piece of the wiper plate of a flat-body wiper, which is permanently connected to the handle, engage upon insertion into squeezing shaft 1. The distance between lateral walls 7*a* and 7*b* of squeezing shaft 1 is dimensioned in the present exemplary embodiment in such a way that the wiper plate is supported simultaneously on both walls upon insertion into squeezing shaft 1 and therefore is stabilized against tipping in the direction toward lateral walls 7*a* and/or 7*b*. Tipping in a direction perpendicular thereto is prevented by guide elements 4*a* in squeezing shaft 1 and counter guide elements 4*b* on the wiper plate.

Figure 2:
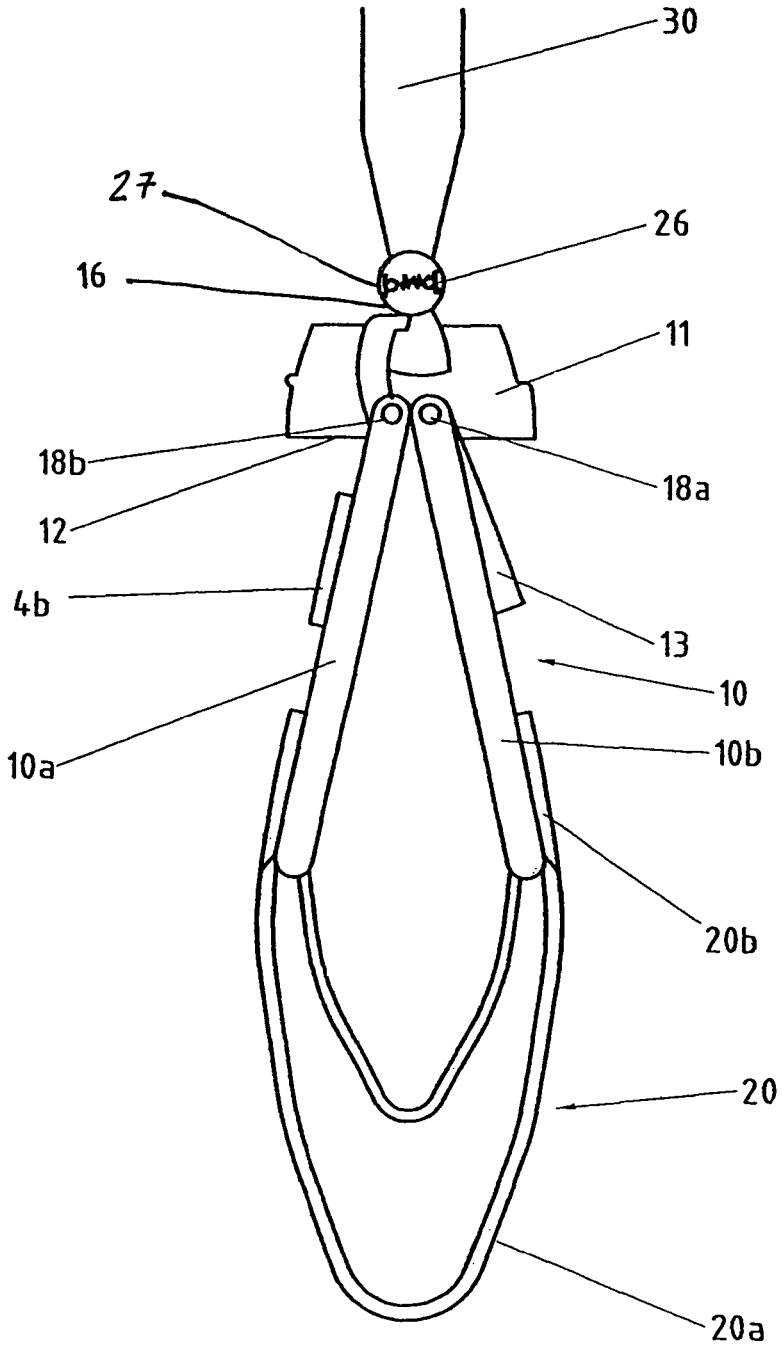
FIG. 2 shows a side view of a flat-body wiper according to the present invention having plate wings folded down and a wiping cover sagging downward in a loop shape.
Figure 3:
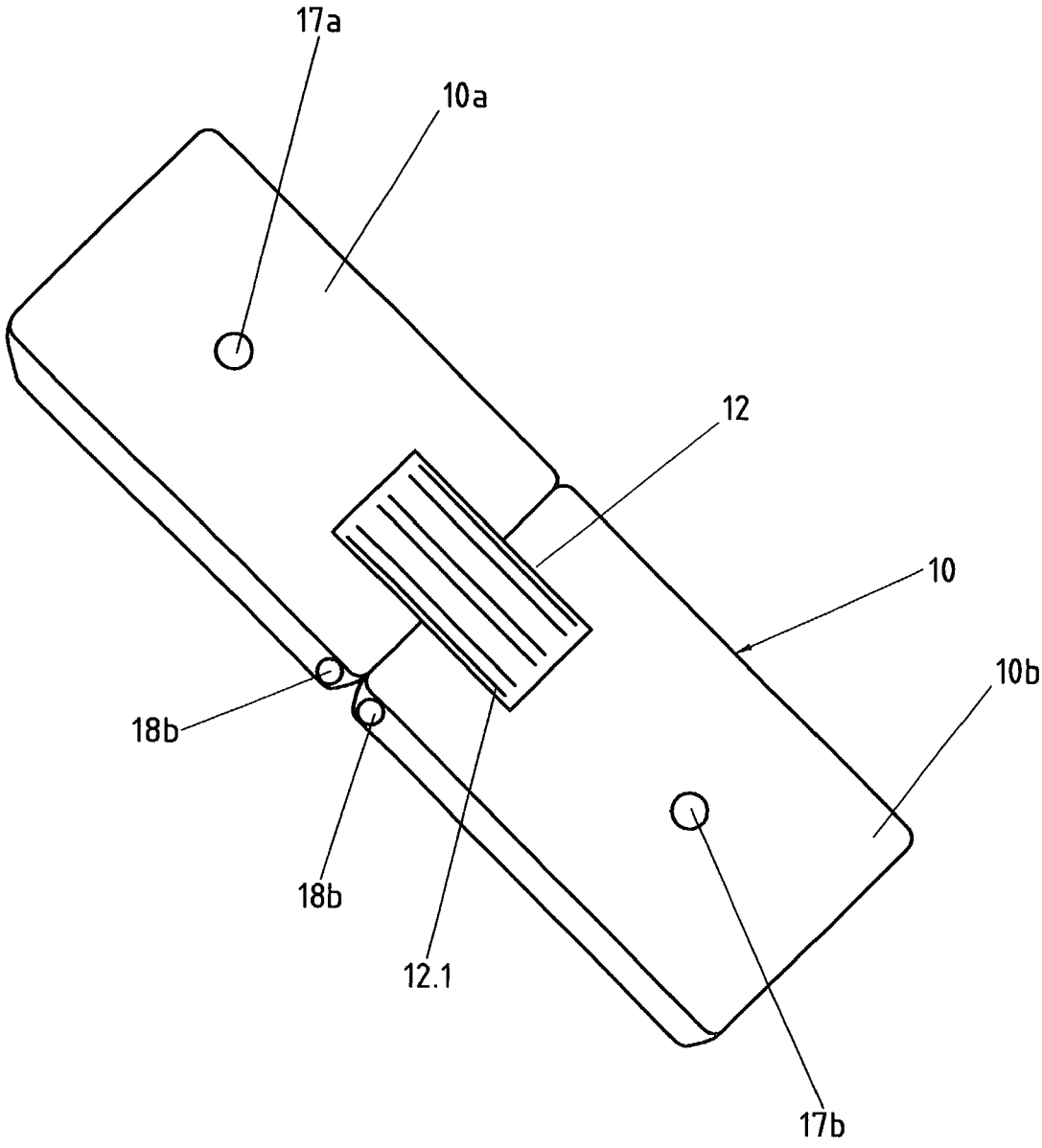
FIG. 3 shows the underside of the wiper plate of the flat-body wiper from FIG. 2.

The squeezing device according to the present invention from FIG. 1 is preferably used for a flat-body wiper as is illustrated in FIG. 2. The wiper head of such a flat-body wiper may be seen in FIG. 2. In particular, two-piece wiper plate 10, wiping cover 20, and the lower region of handle 30, which is permanently connected to middle part 11 of the wiper plate via a joint 16, may be seen. The joint 16 may be lockable using spherical pressure points 26, 27. Two-piece wiper plate 10 includes plate wings 10*a*, 10*b*, which may be pivoted toward one another around shafts 18*a*, 18*b*, to whose lower ends holding tabs 20*b* of wiping cover 20 are detachably attached using a hook and loop fastener. In the figure, both plate wings 10*a*, 10*b* are folded down, due to which wiping cover 20 having cleaning fabric 20*a* sags downward in a loop shape. The wiping cover is in the squeezing position. The plate wings 10*a*, 10*b* may be locked in an aligned operating position using a catch 13. Middle part 11 has, as may be seen in FIG. 3, a functional surface 12 on the underside, which is implemented in the embodiment illustrated, without restriction of generality, in such a way that it is used for removing stubborn stains. For this purpose, functional surface 12 has rib-like elevations 12.1. Functional surface 12 is operable through pressure on handle 30. Wiper plate 10 may include support elements, for example, an elevation 17*a* and a depression 17*b* shown in FIG. 3. The elevation 17*a* on the underside of plate wing 10*a* engages in the corresponding depression 17*b* on the underside of plate wing 10*b* in the folded down position.

Figure 4:
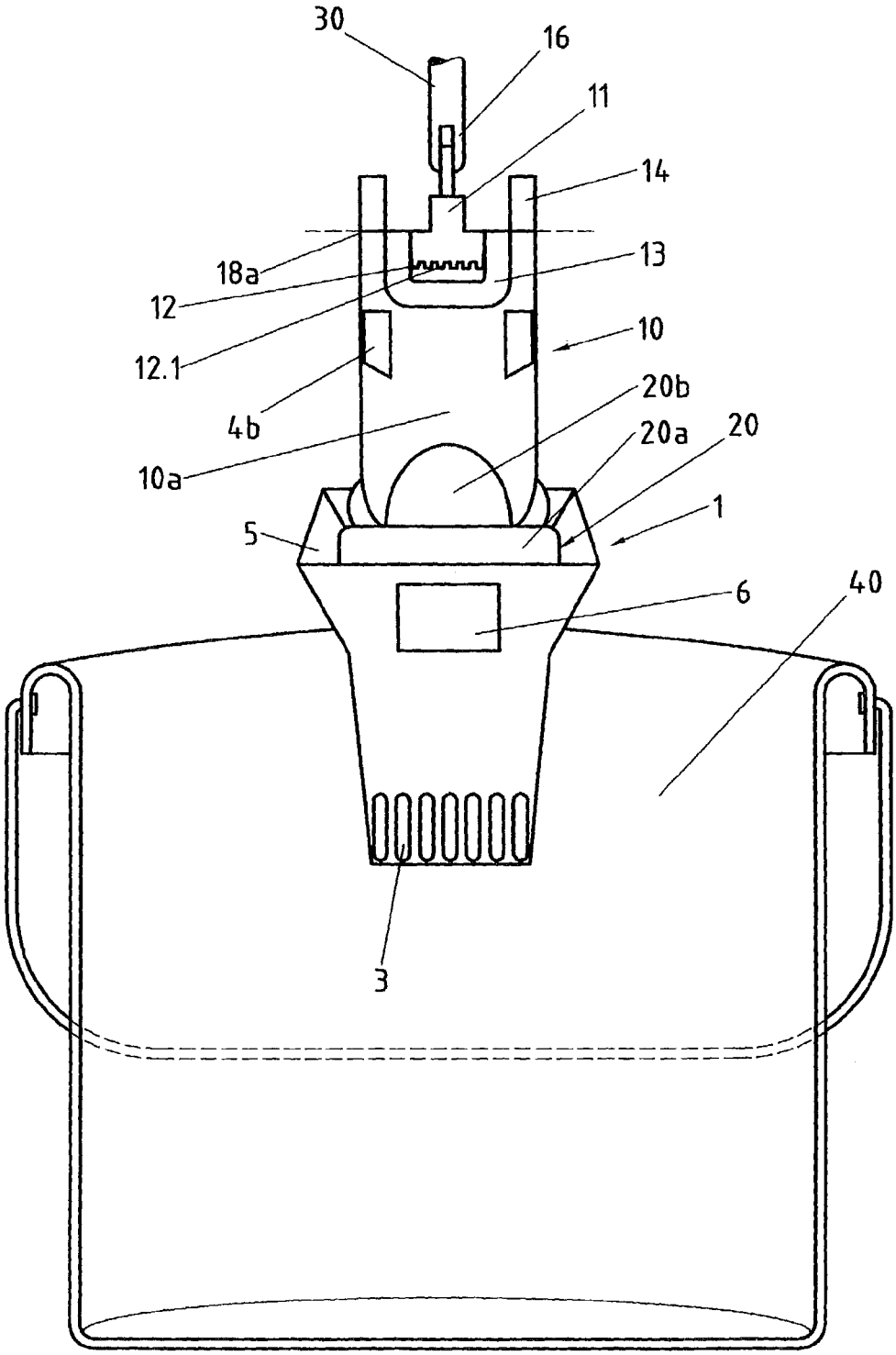
FIG. 4 shows a perspective illustration of a front view of a cleaning system according to the present invention, including a flat-body wiper having a wiper plate and a squeezing device according to the present invention.

FIG. 4 shows the mode of operation of squeezing device 1 according to the present invention from FIG. 1 using the example of a cleaning system according to the present invention. In FIG. 4, wiper plate 10 is already partially inserted into squeezing device 1 in the folded-down, vertical position of plate wings 10*a*, 10*b* with loop-shaped wiping cover 20 sagging downward. It may be seen that wiping cover 20 is already partially located in squeezing shaft 2 of squeezing device 1. Wiping cover 20 is pushed into squeezing shaft 2 until it touches its floor region having counterpressure surfaces. To squeeze out wiping cover 20, wiper plate 10 is then pushed into squeezing shaft 2 by exerting a force on handle 30, its lower face compressing and squeezing out wiping cover 20. Upon insertion into squeezing shaft 2, top sides 10*a*, 10*b* of the folded-down plate wings of the wiper plate are supported on inner walls 7*a*, 7*b* of squeezing shaft 2 and are thus stabilized against tipping in the direction toward these walls. Upon further insertion, wiper plate 10 is also supported using its counter-guide elements 4*b* on corresponding guide elements 4*a* on inner wall 7*a* of squeezing shaft 2 against tipping in the direction toward walls 8*a*, 8*b* of squeezing shaft 2. Wiper plate 10 is thus securely and stably guided in the squeezing shaft while it is squeezed out.

Figure 5:
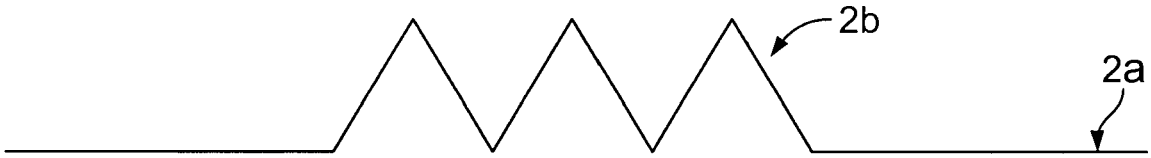
FIG. 5 shows the shaft floor with rib-like elevations.

FIG. 5 shows the shaft floor 2*a* with rib-like elevations 2*b*.

What is claimed is:

1. A squeezing device for a wiping cover of a flat-body wiper having a wiper plate moveable to a vertical position in which the wiping cover hangs downward partially detached from the wiper plate, the wiper plate including a downward facing pressure surface in the vertical position, the squeezing device comprising:

a funnel, having a first tapered rectangular cross-section and a squeezing shaft having a second tapered rectangular cross-section, wherein the second cross-section is narrower than the first cross-section and wherein the second cross-section has a first set of two diametrically opposed inner walls configured to receive and simultaneously support the wiping cover and a first guide element disposed on one of the first set of walls configured to stabilize the wiping plate against tipping a first plane toward the two diametrically opposed inner walls, the shaft including a counterpressure surface in a lower region of the squeezing shaft so that a squeezing pressure of the pressure surface against the counterpressure surface squeezes out the wiping cover, wherein the second cross-section further comprises a second guide element disposed on one of the first set of walls configured to interact with a corresponding counter-guide element on the wiper plate to stabilize the wiper plate against tipping relative to a second plane perpendicular to the first plane.

2. The squeezing device as recited in claim 1, wherein a height of the squeezing shaft is dimensioned such that at least a lower end of the vertically aligned wiper plate is engaged with the stabilizing elements when the wiping cover touches a floor of the squeezing device.

3. The squeezing device as recited in claim 1, wherein the squeezing shaft includes drain openings in the lower region and in a floor of the squeezing shaft.

4. The squeezing device as recited in claim 3, wherein the drain openings include grooves.

5. The squeezing device as recited in claim 1, wherein the counterpressure surface includes elevated regions.

6. The squeezing device as recited in claim 5, wherein the shaft has a shaft floor having ribbed elevations.

7. The squeezing device as recited in claim 1, further comprising an attachment device configured to attach the squeezing device to a cleaning liquid container.

8. The squeezing device as recited in claim 7, further comprising a holding device configured to hold the flat-body wiper in the cleaning liquid container.

9. The squeezing device as recited in claim 1 wherein the counterpressure surface and the pressure surface are flat or planar.

10. The squeezing device as recited in claim 1 wherein the stabilizing elements extend into the funnel-shaped squeezing shaft.

11. The squeezing device as recited in claim 1 wherein the squeezing shaft includes drain openings, the drain openings being separate from at least one stabilizing element.

12. A cleaning system comprising:

a squeezing device as recited in claim 1; and a flat body wiper, wherein a wiper plate includes two wiper plate wings folding down around a shorter transverse axis of the wiper plate in the vertical position and wherein ends of a wiping cover attach to oppositely facing faces of the wiper plate wings.

13. A cleaning system, comprising:

a flat-body wiper having a handle, a wiper plate, and a wiping cover detachably attached to the wiper plate, the wiper plate moveable into a vertical position, in which the wiping cover which sags downward from the wiper plate and a surface of the wiper plate forms a downward-facing pressure surface; and a squeezing device including a funnel-shaped squeezing shaft, wherein the funnel-shape has a first tapered rectangular cross-section and the squeezing shaft has a second tapered rectangular cross-section, wherein the second cross-section is narrower than the first cross-section, and having a counterpressure surface in a lower region of the squeezing shaft, wherein the second cross-section has a first set of two diametrically opposed inner walls configured to receive and simultaneously support the wiping plate against tipping in a first plane toward the two diametrically opposed inner walls, and at least a portion of the wiper plate in the vertical position of the wiper plate so that a squeezing pressure of the pressure surface against the counterpressure surface squeezes out the wiping cover, wherein the second cross-section further comprises a second guide element disposed on one of the first set of walls configured to interact with a corresponding counter-guide element on the wiper plate to stabilize the wiper plate against tipping relative to a second plane perpendicular to the first plane.

14. The cleaning system as recited in claim 13, the wiper plate includes two plate wings foldable toward one another, the wiping cover detachably attachable to outward facing surfaces of the plate wings and sagging downward in a loop shape in the vertical position of the wiper plate.

15. The cleaning system as recited in claim 14, wherein the plate wings are foldable along a shorter transverse axis of the wiper plate.

16. The cleaning system as recited in claim 14, wherein the two plate wings include support elements on sides facing each other in the vertical position, the support elements configured to stabilize both plate wings against a relative movement of the plate wings.

17. The cleaning system as recited in claim 16, wherein the support elements include elevations on one plate wing configured to engage in corresponding depressions on the other plate wing in the vertical position.

18. The cleaning system as recited in claim 14, wherein the flat-body wiper includes a catch for locking the two plate wings in an aligned cleaning position.

19. The cleaning system as recited in claim 14, wherein the wiping cover includes holding tabs each overlapping an outer end of one of the two plate wings.

20. The cleaning system as recited in claim 19, wherein the holding tabs are attachable to the wiper plate using a hook and loop fastener.

21. The cleaning system as recited in claim 13, wherein the wiper plate includes a middle part attached to the handle.

22. The cleaning system as recited in claim 21, wherein the middle part includes a functional surface facing downward and operable by exerting a downward pressure on the handle in a cleaning position of the wiper plate.

23. The cleaning system as recited in claim 22 wherein the functional surface includes texturing with elevated regions, a ratio of a surface area of the elevated regions to a surface area of a cleaning surface of the wiper plate being between 1:10 and 1:100.

24. The cleaning system as recited in claim 23, wherein the ratio is 1:50.

25. The cleaning system as recited in claim 23, wherein the elevated regions are ribs.

26. The cleaning system as recited in claim 13, wherein the flat-body wiper includes a universal joint for connecting the handle to the wiper plate.

27. The cleaning system as recited in claim 26, wherein the universal joint is at least partially lockable in the vertical position of the wiper plate.

28. The cleaning system as recited in claim 27, wherein the universal joint includes spherical pressure points for at least partially locking in the vertical position.

29. The cleaning system as recited in claim 13, further comprising a holding device and cleaning liquid container, the squeezing device attachable to an upper region of the cleaning liquid container, and wherein the holding device is configured to hold the flat-body wiper in the container.

* * * * *